US006578823B1

(12) United States Patent
Johnson

(10) Patent No.: US 6,578,823 B1
(45) Date of Patent: Jun. 17, 2003

(54) ANTIOVERLAP APPARATUS AND METHOD FOR WINCHING DEVICES

(76) Inventor: Kent H. Johnson, 521 Hawthorne Ave., Los Altos, CA (US) 94024

( * ) Notice: Subject to any disclaimer, the term of this patent is extended or adjusted under 35 U.S.C. 154(b) by 33 days.

(21) Appl. No.: 09/699,197

(22) Filed: Oct. 26, 2000

Related U.S. Application Data

(60) Provisional application No. 60/162,844, filed on Nov. 1, 1999.

(51) Int. Cl.[7] ..... B66D 1/36

(52) U.S. Cl. ..... 254/334; 254/380; 254/389; 242/602.2

(58) Field of Search ..... 254/225, 226, 254/242, 333, 334, 335, 336, 380, 382, 383, 389; 242/602.2, 47.03, 47.01, 47.12

(56) References Cited

U.S. PATENT DOCUMENTS

| | | | | | |
|---|---|---|---|---|---|
| 13,429 | A | * | 8/1855 | Gesner | 254/334 |
| 23,499 | A | | 4/1859 | Reed | |
| 88,761 | A | | 4/1869 | Willis | |
| 1,489,902 | A | | 4/1924 | Segelhorst | |
| 1,659,521 | A | | 2/1928 | Dye | |
| 1,734,832 | A | | 11/1929 | Shanklin | |
| 2,497,220 | A | | 4/1950 | Humberson | |
| 3,753,551 | A | * | 8/1973 | Tidwell | 114/218 |
| 3,841,606 | A | * | 10/1974 | Declercq | 114/218 |
| RE30,089 | E | * | 9/1979 | Declercq | 114/218 |
| 4,575,050 | A | * | 3/1986 | Bechmann | 254/286 |
| 4,676,483 | A | | 6/1987 | Magill | |
| 4,819,912 | A | | 4/1989 | Plummer | |
| 5,484,253 | A | | 1/1996 | Johnson | |
| 6,059,266 | A | * | 5/2000 | Ascherin | 242/397.5 |
| 6,073,917 | A | * | 6/2000 | Plummer | 242/602.2 |

OTHER PUBLICATIONS

David Nicolle, "First Time Crew", 1990, pp. 67,68; Adlard Coles, William Collins Sons & Co. Ltd., London, G.B.
JJ and Peter Isler, Sailing for Dummies, 1997, pp. 95,96 IDG Books Worldwide, Foster City, CA.
Donald F. Blair; Arborist Equipment, 1995, p. 201, International Socity of Arboriculture, Savoy, IL.

* cited by examiner

*Primary Examiner*—Emmanuel Marcelo
(74) *Attorney, Agent, or Firm*—Thomas M. Freiburger

(57) ABSTRACT

Apparatus and methods for preventing overlap of coils on a cable of a rotatable winch drum have a rotatable roller which is mounted at a certain location with respect to the axis of rotation of the winch drum. The rotatable roller has an outer surface which is engageable with a side surface of the incoming coil of the cable as the incoming coil is being formed. The rotatable roller exerts a sufficient force through the roller and the body of the cable at the incoming coil to maintain the roller engaged portion of the incoming coil at the location of the rotatable roller and to shift all previously formed engaging adjacent coils of the cable sufficiently longitudinally on the surface of the winch drum in a direction along the axis of rotation of the winch drum so as to make room for the formation of the incoming coil directly on the surface of the winch drum. Forming the incoming coil directly on the surface of the winch drum in this way eliminates any crossing or overlapping of the incoming coil on the previously formed adjacent coils.

29 Claims, 8 Drawing Sheets

FIG_13
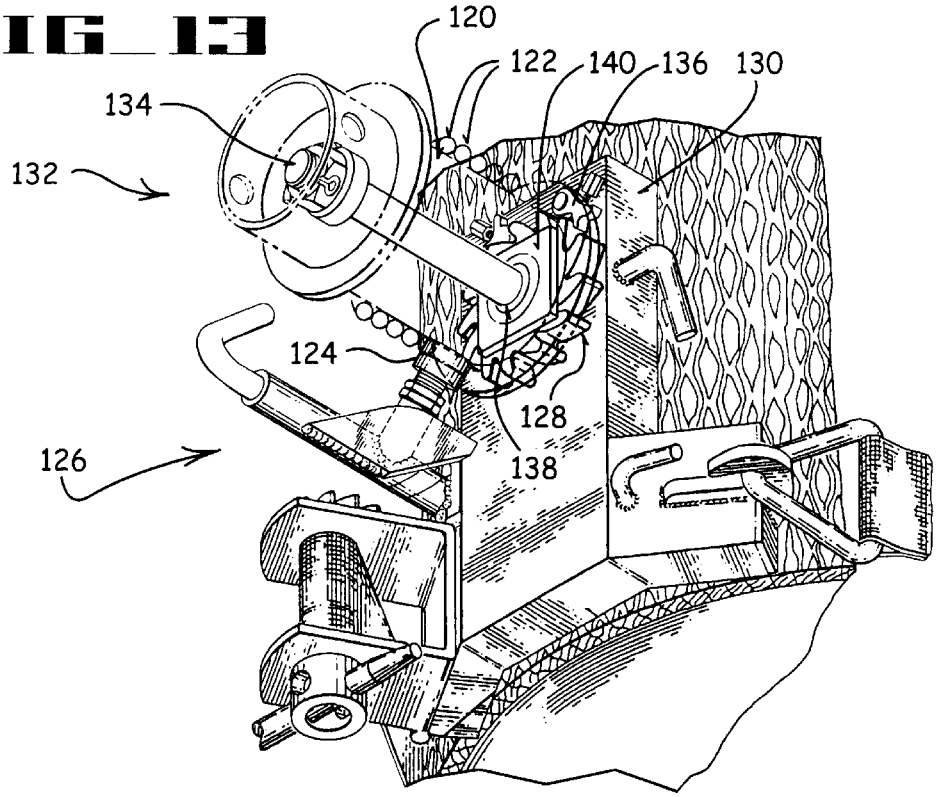
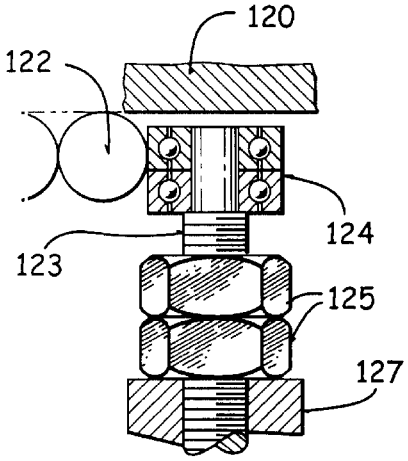
FIG_15
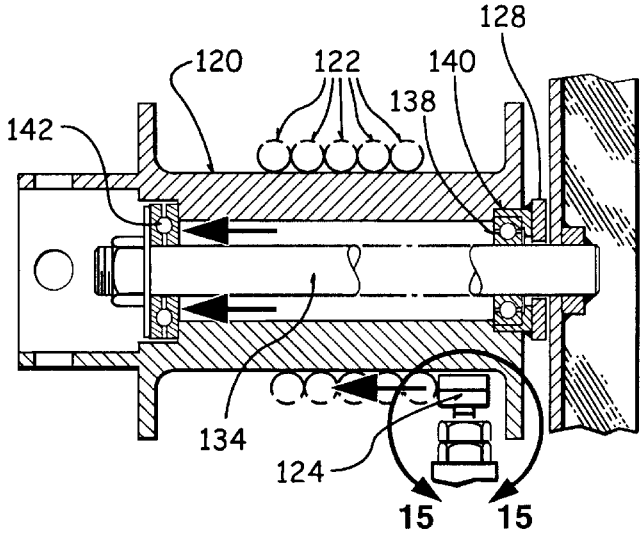
FIG_14

FIG_16
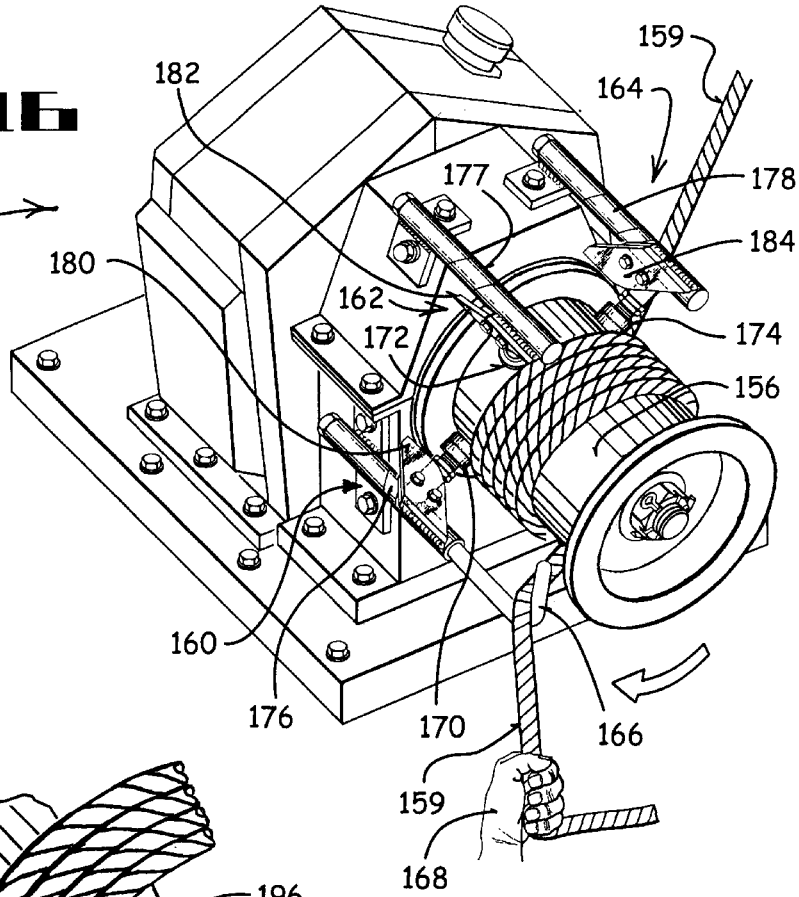
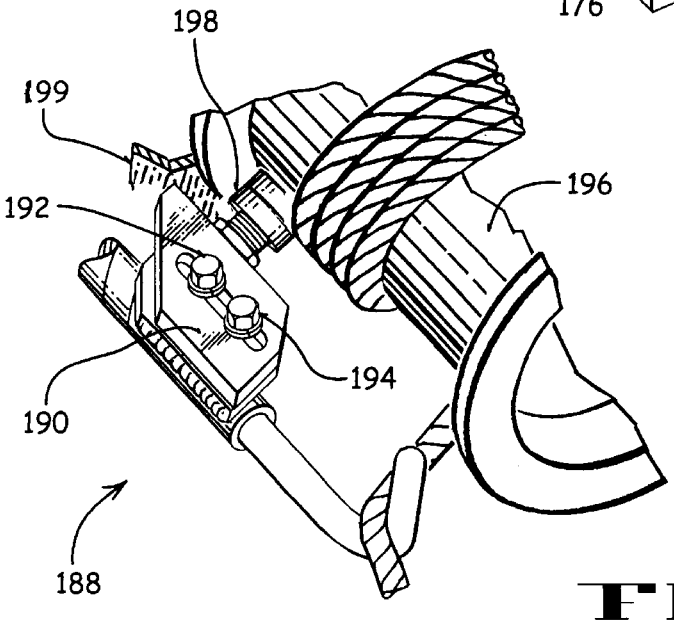
FIG_17

ANTIOVERLAP APPARATUS AND METHOD FOR WINCHING DEVICES

RELATED APPLICATION

This application claims the priority of U.S. Provisional Application Serial No. 60/162,844 filed Nov. 1, 1999 by Kent H. Johnson.

BACKGROUND OF THE INVENTION

This invention relates to winching apparatus and methods of the kind in which coils of a cable are formed on a rotatable winch.

As used in this application, the term "cable" includes both metal strand cable and rope of any dimension.

More particularly, this invention relates to winching devices with rotating drums (including capstans, catheads, nautical winches, utility winches, windlasses and self-tailing winches) which function with only a single layer of cable wrapped one or more times around the winch drum. Such winching devices are commonly used with rope in rigging procedures by arborists to trim and remove trees and by sailors to handle sails and other functions on ships. In both these cases, overlapping of turns of the rope on the drum of a winch is a common, well-known, and long-standing problem. Such overlapping of ropes not only can stop the useful operation of a winch but also can result in serious safety problems that often require time, additional equipment, and rigging expertise to resolve safely. Such required rigging expertise most often does not reside with the person normally assigned to routine operation of the winch.

There are two particular modes of operation of winching devices used by both arborists and sailors that often lead to rope overlaps on the winch drum.

One mode that results in rope overlap is during the normal application of the winching device to move the load attached to the winch rope, but the operator inadvertently fails to stop operating the winch even though the incoming rope coil climbs up and overlaps the adjacent coil. FIG. 1 and FIGS. 3–6 of the drawings and related text illustrate and discuss this mode.

Figure 2:
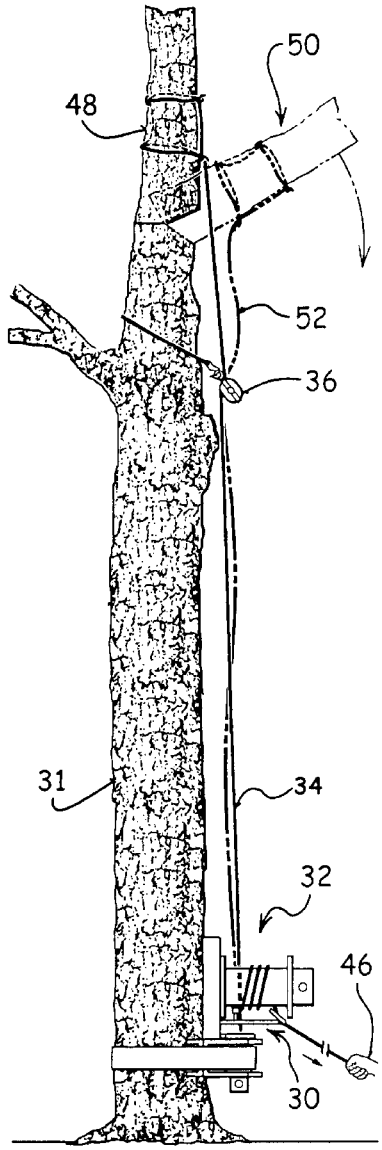
Figure 18:
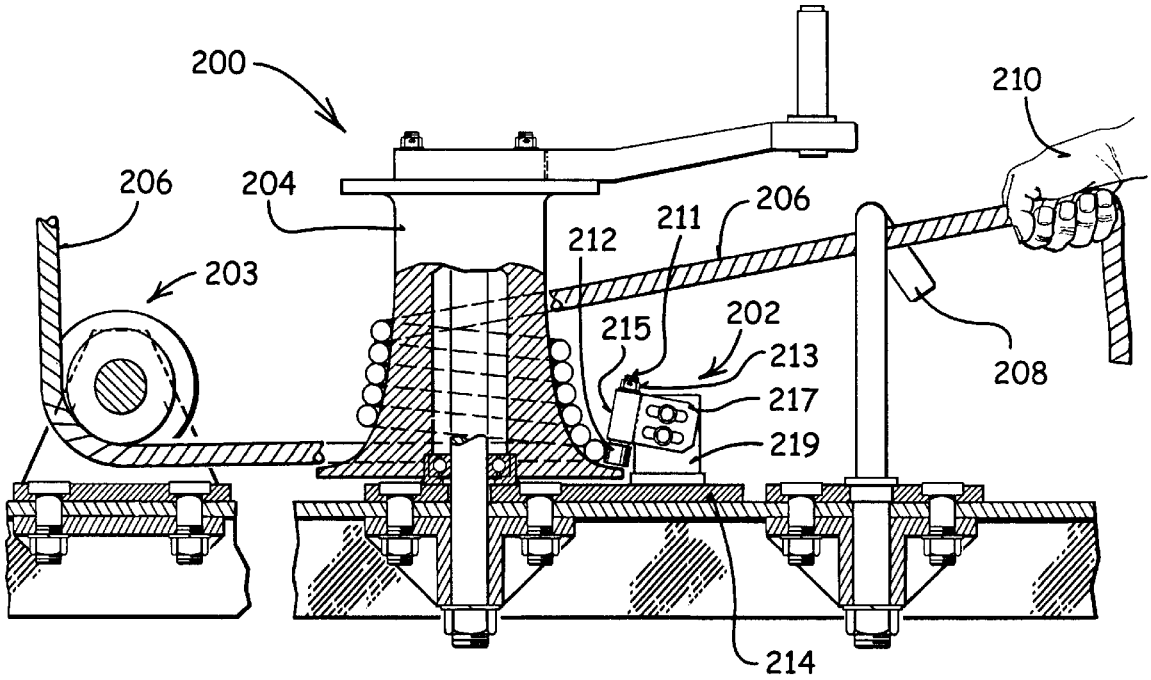

The second operating mode which frequently results in rope overlaps is when rapid load reduction produces slack in the load rope between the winch and the load and the operator rapidly applies force to the tail end (operator-end) of the rope to remove the slack. In arborist applications, rapid removal of the slack can significantly reduce the fall distance of a severed tree segment and thereby reduce the shock loading of the winch and related rigging system when the falling segment is suddenly stopped by the winch. In sailing applications, rapid removal of the slack enables the winch operator to more quickly position the sail at a desired location, and thus to more quickly control the actions of the boat. FIGS. 2 and 18 of the drawings and related text of this application illustrate and discuss this second operating mode.

In some winching devices, fleeting (axial sliding) of cable along the winch drum is achieved by having the incoming load cable slide along a short helical ramp or other contoured ramp surfaces attached to the winch frame. The sliding of the load cable along a fleeting-force surface produces frictional heating of the fleeting-force surface and frictional heating and abrasion of the cable surface. The related frictional force significantly adds to the load-produced force on the winch drum, and thus the rotational torque required to turn the winch drum is significantly increased compared to low-friction fleeting techniques. Reduced torque requirements are generally important for powered winches, and are particularly important for manually operated winches. Also such sliding fleeting-force apparatus could become very complex if they were to be used with winch drums that are contoured axially, such as self-fleeting drums.

SUMMARY OF THE PRESENT INVENTION

The methods and apparatus of the present invention prevent overlap of coils of a cable on a rotatable winch.

The methods and apparatus of the present invention also reduces the torque force required to rotate the winch drum, as compared to the torque force required to rotate the winch drum of prior art methods and apparatus that use ramp-produced fleeting forces.

The methods and apparatus of the present invention incorporate a rotatable roller mounted at a position to engage a side surface of the incoming coil of the cable as the incoming coil is being formed. The roller engages the incoming coil with sufficient force to maintain the roller engaged portion of the incoming coil at the location of the rotatable roller and to shift (fleet) all previously formed and engaging, adjacent coils sufficiently longitudinally on the surface of the winch drum so as to make room for the formation of the incoming coil directly on the surface of the winch drum. This prevents any crossing or overlapping of the incoming coil onto the previously formed adjacent coils. Also, because the roller surface rotates as it engages the side surface of the incoming cable coil, a sliding frictional force between the roller surface and the engaged cable surface is eliminated or minimized.

In the present invention a rotatable winch has an outer, curved, peripheral surface for receiving an incoming portion of a cable and for permitting the formation of multiple adjacent coils on the winch surface during operation of the winch. The winch is rotatable in one direction to start the formation of an incoming, load bearing coil of cable on the winch.

It is a primary object of the present invention to use the rotatable roller in a way to move all of the coils of cable axially along the surface of the drum during operation of the winch apparatus without any overlapping of the incoming coil onto the previously formed adjacent coils of cable independent of the operational cable forces applied at either end of the engaged cable segment.

In the present invention, the rotatable roller is mounted at a certain location with respect to the axis of rotation of the winch. The outer surface of the rotatable roller engages a side surface of the incoming coil of the cable as the incoming coil is being formed on the rotating surface of the winch.

The rotatable roller exerts a sufficient force in an appropriate direction through the roller and the body of the cable of the incoming coil to maintain the roller-engaged portion of the incoming coil at the location of the rotatable roller and to shift all previously formed, engaging, adjacent coils of the cable sufficiently longitudinally on the surface of the winch so as to make room for the formation of the incoming coil directly on the surface of the winch. As a result, the incoming coil is prevented from crossing or overlapping the previously formed adjacent coils independent of the operational cable forces applied at either end of the cable segment engaged with the surface of the winch.

It is a further object of this invention to produce approximately zero sliding friction at the area of engagement of the roller surface with the cable. This minimizes roller surface heating and cable surface abrasion and heating. This also reduces the required winch torque as compared to the winch torque required to overcome large frictional forces that often occur in winches which produce cable fleeting by forcing the cable to slide along inclined ramps, screw-shaped segments, or other contoured segments to produce the required fleeting force.

It is a further object of this invention to enable embodiments of the apparatus to perform as effectively and efficiently with winch drum surfaces that are axially contoured (e.g., self fleeting surfaces) as it does on drum surfaces that have a constant radius axially (non self fleeting surface).

It is a further object in some embodiments of this invention that roller and selected structural elements can quickly and easily be detached from structural elements permanently attached to the winch frame and can be quickly reattached and accurately aligned with the drum surface by a self-aligning element of the apparatus. This feature enables the operator to efficiently remove and replace the roller unit if it becomes worn or damaged during its use or if the roller unit is not required for some functions of the winching device.

A further object of this invention is that a detachable roller unit be combined in some embodiments with other cable positioning elements such as fairlead cable guides to enable an operator to more safely control the tail end of the cable from a wide range of angles with respect to the axis of the winch drum.

Antioverlap apparatus and methods for winching devices which incorporate the features noted above and which are effective to function as described above comprise specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

Figure 1:
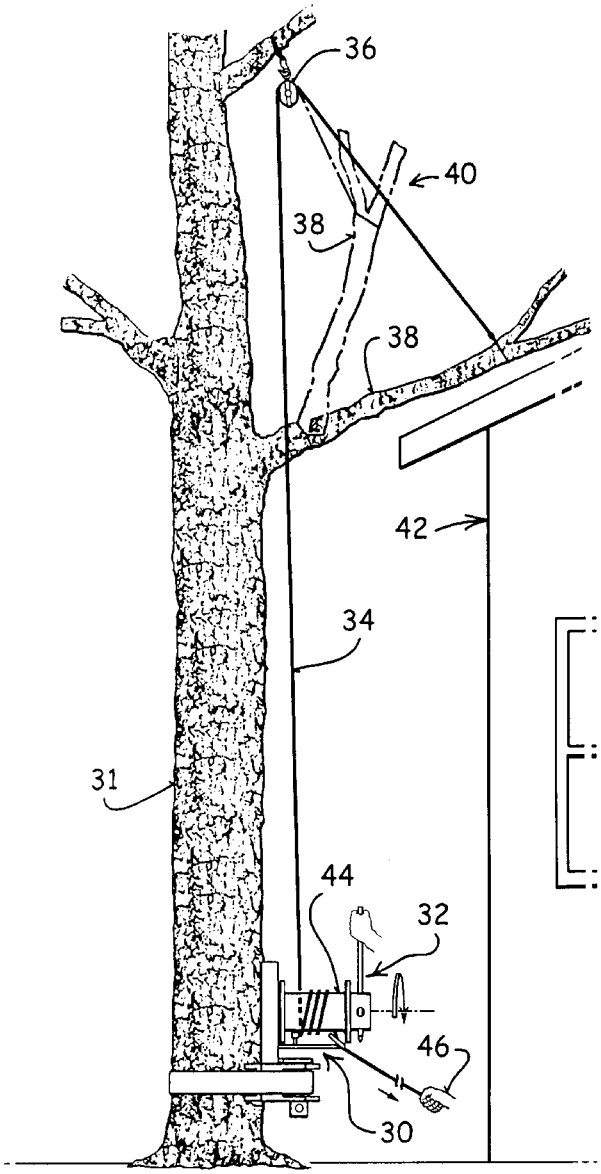

FIG. 1 is a schematic side view of a tree and an attached, manually-operated, ratcheting winch that incorporates a coil engaging roller mechanism constructed in accordance with one embodiment of the present invention. The coil engaging roller mechanism itself is shown and described in more detail below. FIG. 1 illustrates a frequently used arborculture application of a winching device to lift tree limbs away from houses and other job-related obstructions. In FIG. 1, a tree limb is shown by solid lines in an initial position over the roof of a structure with a load rope leading from the winch drum through a pulley to the attachment point on the tree limb. The tree limb is notched with a saw near the tree stem by an arborist, and the winch drum is manually turned to lift the tree limb to the position indicated in phantom by the dotted lines. The use of the coil engaging roller mechanism of the present invention in this type of arborist procedure prevents overlapping of rope coils on the winch drum, both during rapid take up of slack in the load rope and during lifting of loads; and thus avoids related functional and safety problems that can occur with prior art winching devices.

FIG. 2 is a schematic side view, like FIG. 1, and schematically illustrates an arborist procedure for removing tree stem wood with the winching device of FIG. 1. In FIG. 2, the load rope leading from the winch drum through the illustrated pulley is attached to the upper tree segment that is being removed. The winch is then used to remove slack from the load rope. The upper stem wood segment is then sawed off; and, as the stem wood falls, slack in the load rope develops (as illustrated by the dashed lines of the load rope). To remove this slack rope, and thus to limit the fall distance of the stem wood before the winch and the pulley halt its fall, the winch operator pulls rapidly on the exiting end (tail end) of the rope (as illustrated by the hand at the lower right part of FIG. 2). This pulling of the exiting end of the rope adds new coils of rope to the incoming end of the winch drum, as the incoming slack rope is wrapped around the drum. The present invention (as described in more detail below) prevents overlapping of the incoming rope coils onto the previously formed coils on the winch drum during this arborist procedure.

Figure 3:
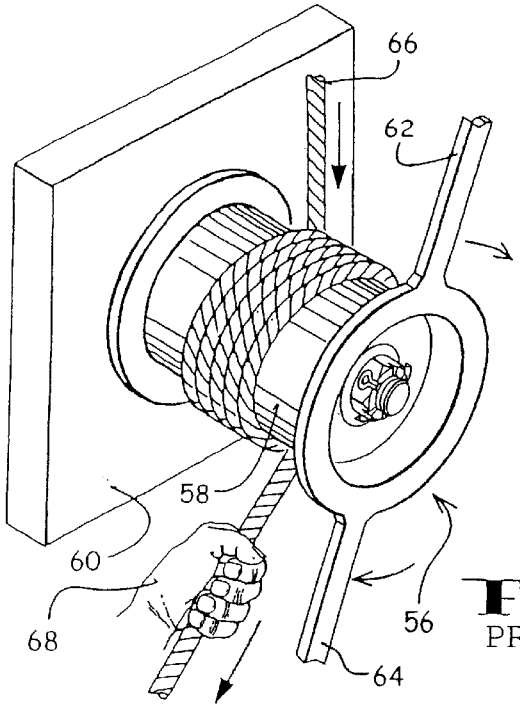
FIG 3 PRIOR ART

FIG. 3 is an isometric view which schematically illustrates coils on the drum of a prior-art, manually-operated winch. In FIG. 3 the coils are shown in the positions produced on the drum before an arborist begins to lift a tree limb (such as illustrated in FIG. 1). As the winch drum is turned, additional, incoming coils of rope are added near the load-end of the drum. At the same time, an approximate equal number of coils are removed from the exit end of the drum as the winch operator pulls on the exiting rope (as illustrated schematically by the hand at the bottom left part of FIG. 3).

Figure 4:
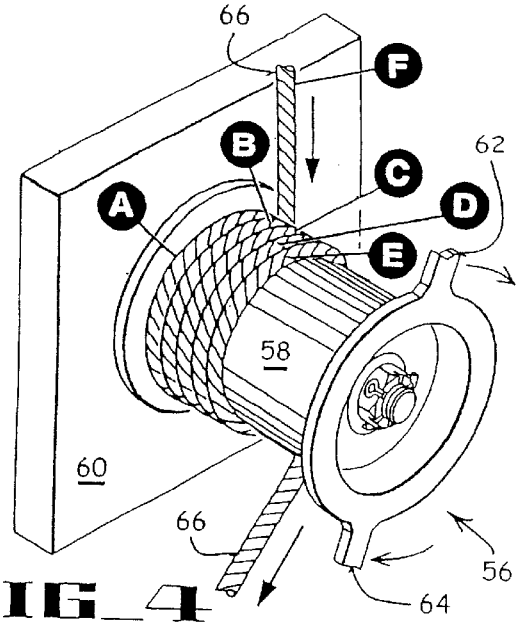
FIG 4 PRIOR ART

FIG. 4 is an isometric view of the prior art winch shown in FIG. 3, but shows the position of rope coils produced on the winch drum after a few turns of the winch drum. The incoming, newly formed coils naturally "corkscrew" longitudinally inwardly as the winch drum is manually rotated in the clockwise direction indicated by the direction arrows in FIG. 3. At a certain point the most recently formed coil, the rope coil "A" comes into contact with the base-end flange of the winch drum, and the other rope coils "B", "C", "D" and "E" are each in contact with their adjacent rope coils.

Figure 5:
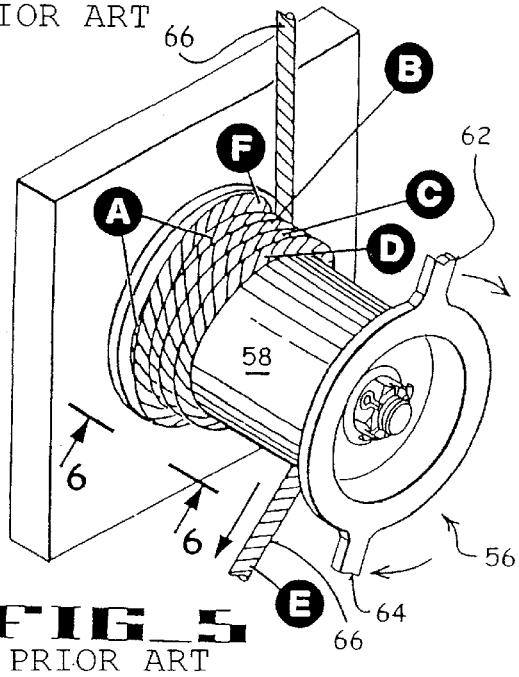
FIG 5 PRIOR ART

FIG. 5 is another isometric view of the prior art winch drum shown in FIGS. 3 and 4. FIG. 5 shows the condition of the rope coils as the winch drum and coils shown in FIG. 4 are continued to be rotated in the clockwise direction indicated by the direction arrows in FIG. 5. FIG. 5 shows that, when the winch drum illustrated in FIG. 4 is rotated approximately one additional turn, the rope coil "F" overlaps rope coils "A" and "B", because there is no space on the incoming load-end of the drum surface for the coil "F" to form on the surface of the winch drum. Instead of being formed on the drum surface, the incoming coil "F" must form on top of the existing coils. The incoming coil "F" (as illustrated in FIG. 5) overlaps and crosses over the top of the coils "A" and "B". In FIG. 5 the rope coil "E" of FIG. 4 has been rotated off the drum by one turn of the winch, as illustrated by the letter "E" in FIG. 5. Overlapping of rope coils on winch drums can be a problem with prior-art winch devices used by arborists in tree trimming and removal procedures. The overlapping of rope coils can produce serious functional and safety problems.

Figure 6:
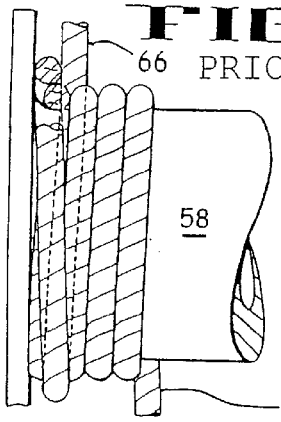
FIG 6 PRIOR ART

FIG. 6 is a side elevation view (taken along the line and in the direction indicated by the arrows 6—6) of the winch device illustrated in FIG. 5. FIG. 6 shows how the incoming coil "F" crosses over and overlaps the prior formed rope coils.

Figure 7:
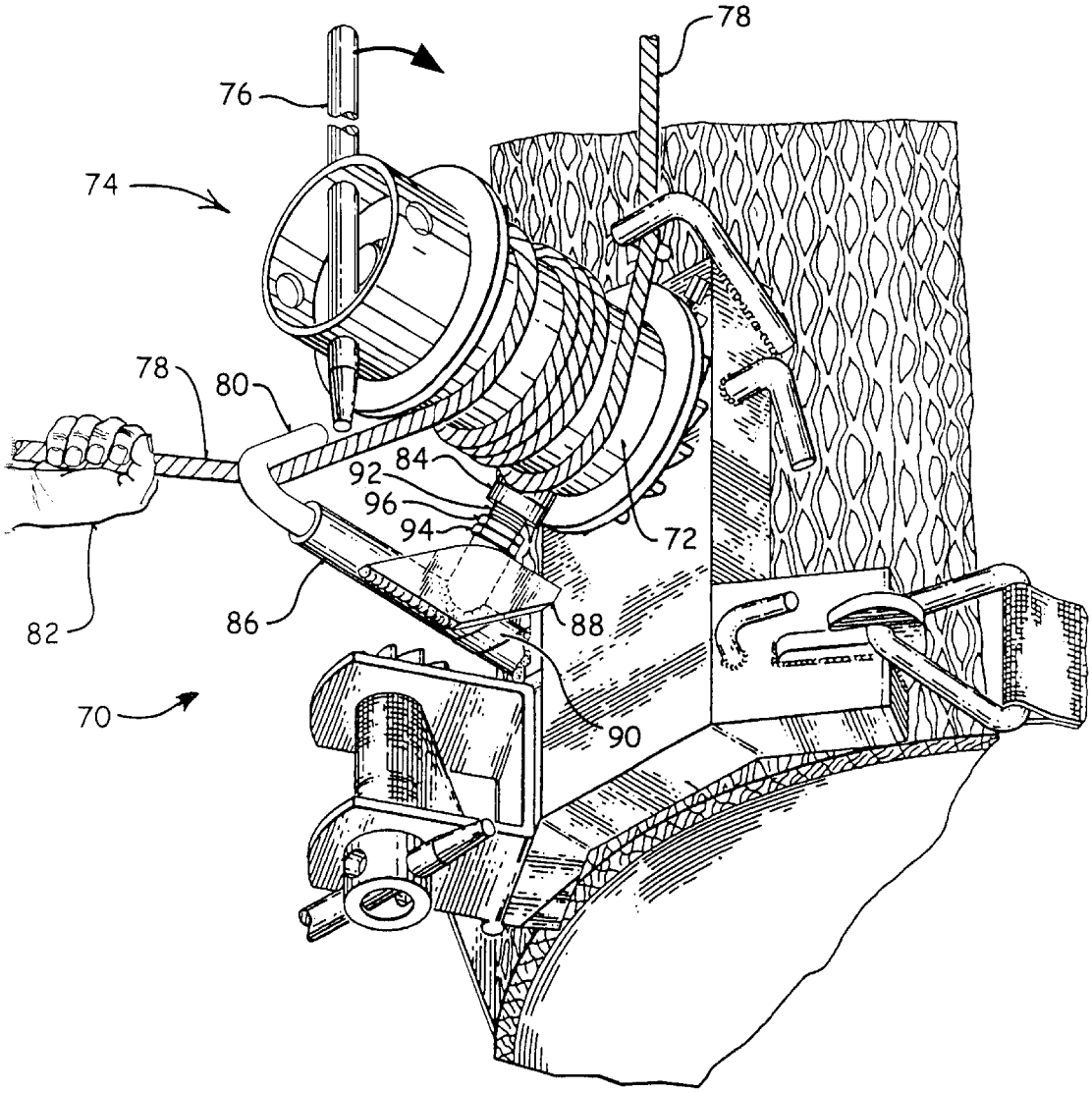

FIG. 7 is an isometric view showing a winching apparatus mounted on the trunk of a tree. The conformed frame apparatus for mounting the winch is disclosed in my U.S. Pat. No. 5,484,253 issued Jan. 16, 1996. This U.S. Pat. No. 5,484,253 is incorporated by reference in this application. The winching apparatus shown in FIG. 7 incorporates a coil engaging roller mechanism constructed in accordance with one embodiment of the present invention (and described in more detail below). In FIG. 7 a roller system of the present invention is shown operatively positioned adjacent to the first rope coil being formed by the load rope entering the winch drum (the rope enters from the top part of FIG. 7). The right hand of the winch apparatus operator is indicated schematically by the hand (at the left side of FIG. 7) pulling on the rope as it exits the winch drum through a fairlead hook of the present invention. The winch drum is rotated manually by the handle shown at the open end of the winch drum.

Figure 8:
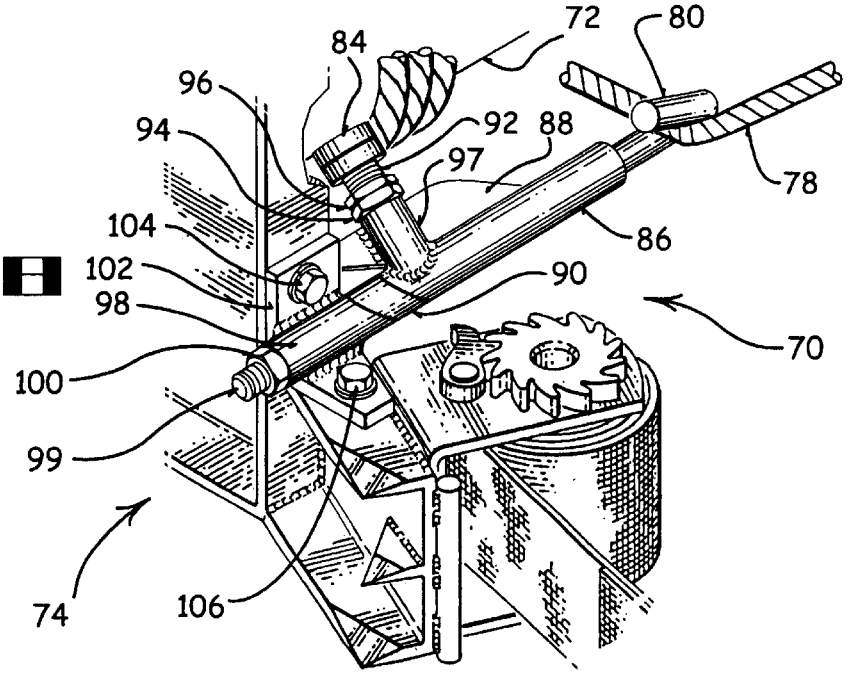

FIG. 8 is an isometric view that illustrates one embodiment of this invention used for mounting the coil engaging roller in its operative position on the frame of the winching apparatus illustrated in FIG. 7.

Figure 9:
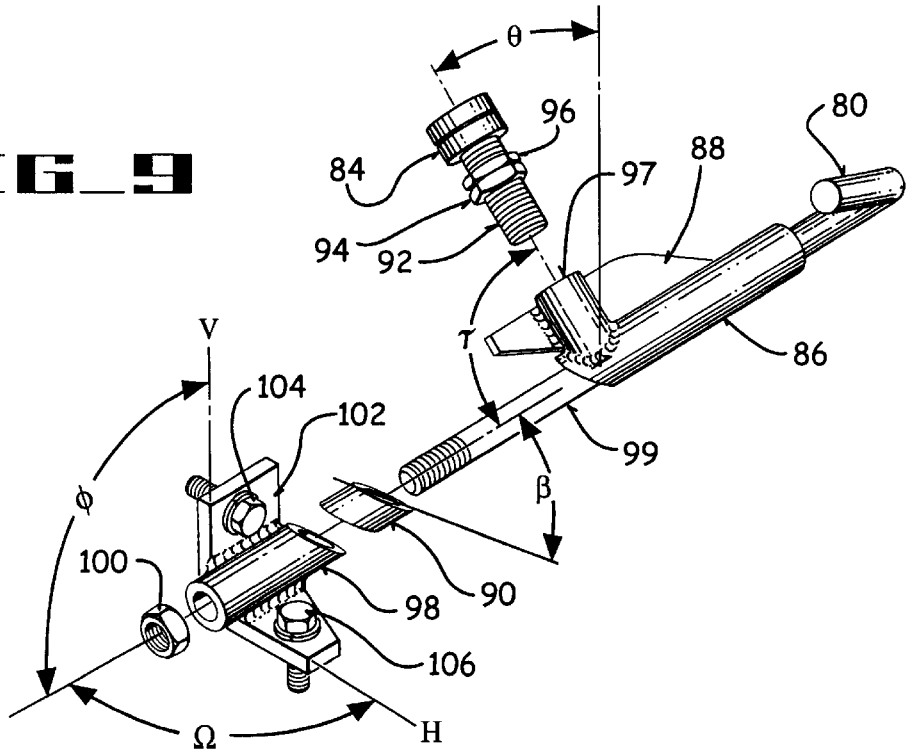

FIG. 9 is an isometric, exploded view showing component parts of mounting and positioning structures for mounting and positioning a coil engaging roller of the present invention. The mounting and positioning structure shown separately in FIG. 9 may be used for positioning the roller shown in FIGS. 7 and 8, but this structure may also be used for positioning a coil engaging roller in other winching apparatus. The angles $\phi$ and $\Omega$ are selected such that the axis of the threaded support shaft, when mounted on the winch apparatus, is approximately parallel to the axis of the winch drum. The angle $\theta$ is selected such that the axis of the roller unit approximately intersects the rotation axis of the winch drum, and the angle T is approximately 90 degrees.

Figure 10:
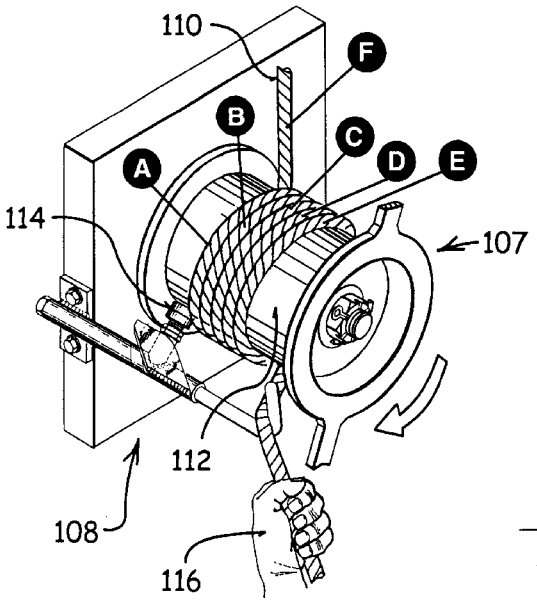

FIG. 10 is an isometric view which schematically illustrates a winch apparatus having a coil engaging roller mechanism constructed in accordance with one embodiment of this invention and mounted on the winch apparatus. Five coils of rope are shown on the winch drum surface. The roller mechanism is engaged in contact with a side portion of the rope coil "A", and the rope segment "F" is under the tension of a load force. A winch apparatus operator applying a pull on the rope exiting the winch drum is indicated schematically by the hand on the exiting rope segment.

Figure 11:
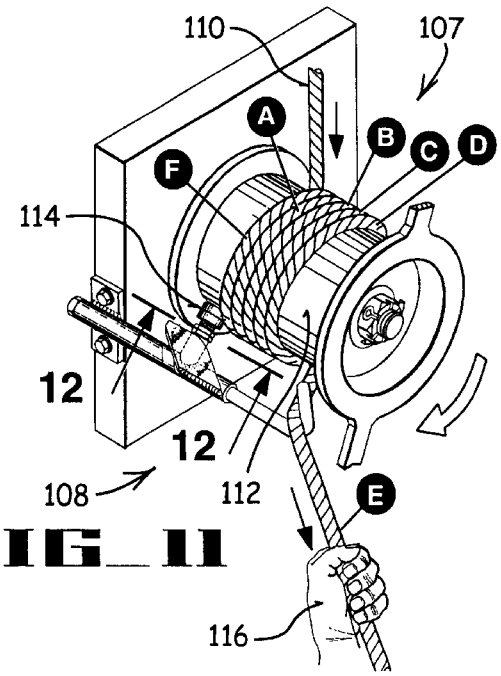

FIG. 11 is an isometric view and illustrates the positions of rope coils after the winch drum illustrated in FIG. 10 has been turned by approximately one turn. A new coil "F" (corresponding to the rope segment "F" shown in FIG. 10) has been added to the winch drum as coils "A", "B", "C", and "D" have been forced by the roller surface and the entering rope coil "F" to slide axially along the drum surface (by approximately one rope diameter) toward the rope exit position on the drum. The rope coil "E" (shown in FIG. 10) has exited the drum as the rope segment "E" after one turn of the drum as shown in FIG. 11.

Figure 12:
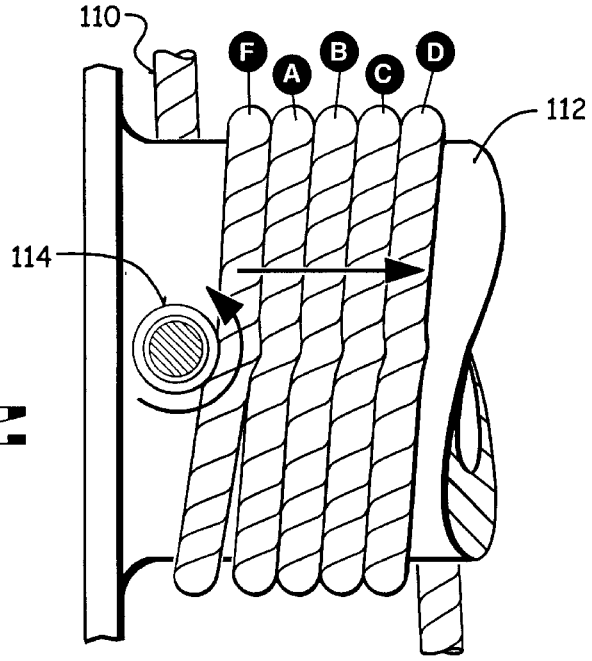

FIG. 12 is a side elevation taken along the line and in the direction indicated by the arrows 12—12 in FIG. 11. FIG. 12 illustrates the interaction of the roller surface with the entering coil "F" and the interaction of the localized force transmitted through the coil "F" to the adjacent coils "A" and "D" as the roller rolls along the inner surface of the coil "F". FIG. 12 indicates (in somewhat emphasized form) the localized roller surface compression force and the rope coil displacement effects on coils "F", "A", "B", "C", and "D" as entering coil "F" is forced by the rotating drum between the roller surface and rope coil "A".

FIG. 13 is an isometric view like FIG. 7, but parts of FIG. 13 have been illustrated in phantom outline in order to show the underlying locations of the bearing assemblies and the ratchet gear assemblies of the apparatus illustrated in FIG. 7. FIG. 14 also shows the rope coils as a phantom overlay on the winch drum.

FIG. 14 is a side elevation view in cross section through the winch shown in FIGS. 7 and 13. FIG. 14 shows schematically the locations of axial forces on the winch drum surface and the thrust bearing near the nose of the winch drum. The direction arrow through the rope coils near the roller unit of the present invention indicates the force on the coils exerted by the roller mechanism and also the displacement direction of the coils (as was illustrated in FIG. 12). This axial force on the rope coils at the surface of the roller unit is transferred to the winch drum by the frictional force existing between the inner surfaces of the rope coils and the outer surface of the winch drum. The axial forces on the drum produced by these frictional forces are transferred to the thrust bearing assembly (as indicated schematically by the two direction arrows on the inner surface of the drum). The axial thrust is taken by the thrust bearing (illustrated at the outer, left hand side as viewed in FIG. 14) of the winching apparatus. Other forms of thrust bearings may be used. For example, the thrust bearing may be one of those shown and/or described at pages 679–681 of the publication *McGraw-Hill encyclopedia of Science & Technology*, $7^{th}$ Edition, copyright 1992 and published by McGraw-Hill, Inc. These pages 679–681 are incorporated by reference in the application.

FIG. 15 is a partial cross section of a portion of the roller assembly indicated by the arrows 15—15 in FIG. 14. FIG. 15 illustrates the roller bearing assembly and adjacent mounting structure.

FIG. 16 is an isometric view illustrating a power-driven winch apparatus having a coil engaging roller mechanism constructed in accordance with one embodiment of the present invention. The power-driven winch apparatus shown in FIG. 16 is useful for applications producing winch load forces extending to several tons. As illustrated in FIG. 16, three antioverlap units of the present invention are removably attached to the housing unit covering the winch gears and the winch drum support structure. The roller units are spaced axially, in a generally spiral pattern, to share the load forces required to continuously slide (fleet) the rope coils axially along the winch drum as the drum rotates.

FIG. 17 illustrates an adjustable structural gusset which may be used in one embodiment of the present invention to enable small adjustments of the winch apparatus by operators in the field for changes in rope diameter or compressibility. This adjustable gusset is particularly effective for multiple coil-engaging roller mechanisms, such as, for example, the FIG. 16 apparatus, when load forces are large and applications may require changes in the rope diameter or rope compressibility.

FIG. 18 is a schematic side elevation view, mostly in cross section, illustrating a manually-operated self-fleeting winch apparatus of the general kind commonly used on sailing vessels but having an additional, coil engaging roller mechanism constructed in accordance with the present invention for preventing coil crossover or overlap. The winch drum surface is axially curved to enable a self fleeting of the rope coils on the drum; but overlapping of rope coils on prior-art winch apparatus is still a frequent problem when load forces on the winch are rapidly changing. This problem of overlapping of rope coils can be prevented by the incorporation of the coil engaging roller mechanism of the present invention as illustrated and described in more detail below.

DETAILED DESCRIPTION OF PREFERRED EMBODIMENTS

One preferred embodiment of the present invention 30 is shown schematically in FIG. 1 and FIG. 2 attached to a tree-mounted manually operated winch apparatus 32 of the type frequently used in the tree service industry by arborists to trim and remove trees.

In FIG. 1 the winch apparatus 32 is attached to the tree 31 and the load rope 34 is attached through the pulley 36 to the tree limb 38 that extends over the structure 42. After the tree limb is notched by an arborist, the winch drum 44 is manually rotated clockwise to lift the tree limb 38 away from the structure 42 to a new position illustrated in the phantom sketch 40. In this type of arborist operation without the present invention 30 attached, rope overlap on the drum 44 of winch apparatus 32 is a frequent problem for lifting a tree segment more than a few feet. (This problem is discussed in further detail in relation to FIGS. 3–6). However, facilitated by the present invention, rotation of the drum 44 adds new single-layer rope coils to the drum 4, while coils of rope previously on the drum 44 exit from the drum 44. Exiting of coils of rope from the drum 44 is facilitated by the present invention 30, while coils of rope previously on the drum 44 exit from the drum 44, facilitated by the winch apparatus operator pulling on the exiting rope as illustrated schematically by the hand 46. After the limb 38 is lifted up and fully severed from the tree by the arborist, the limb 38 can be safely lowered to the ground away from the structure 42 by the operator 46 slowly releasing tension on the tail end of the rope 34 and thus allowing the load force on the rope 34 to pull rope off the stationary winch drum 44 and through the operator's hand 46 until the tree limb is on the ground.

In FIG. 2, the removal of a section of stem wood 48 is illustrated schematically being removed from the tree 31. The load rope 34 is attached by an arborist through the pulley 36 to the stem-wood section 48 prior to sawing off the section 48. After the section is sawed off and falls from the tree 31 as indicated by the phantom sketch 50, slack develops in the load rope as indicated by the phantom sketch of the load rope 52. To reduce the distance that the severed stem wood section 48 falls (and thus to minimize the high shock loading of the load rope 34, the pulley 36, the pulley attachment rope 54, and the winch apparatus 32), the winch apparatus operator 46 pulls rapidly on the exiting load rope 34. This action rotates the winch drum and keeps the slack in the rope to a minimum as the stem-wood segment 48 falls until it is stopped by the pulley 36 and the operator 46 using the winch apparatus 32. The stem wood is then safely lowered to the ground as discussed for the tree limb 38 in FIG. 1.

In the prior art method of rope slack removal by the winch operator 46 (taking of slack without the benefit of the present invention 30 attached to the winch apparatus 32) rope overlap on the winch drum is a common problem that can prevent lowering of the attached load. This problem is discussed further in relation to FIGS. 3–6 and FIG. 18.

FIGS. 3, 4, 5 and 6 illustrate schematically the conditions for and the formation of overlapping rope coils on a winch drum of the ratcheting, unidirectional type commonly used in the tree service industry for tree trimming and removal. Such a device is described in U.S. Pat. No. 4,239,188 entitled *Tree Handling Device*. This U.S. Pat. No. 4,239,188 is incorporated by reference in this application.

FIG. 3 is an isometric illustration of a manually-operated winch apparatus 56 with a winch drum 58 extending from a base 60. The rope 66 is shown entering the drum at the top from the loaded end of the rope 66, coiling five times around the drum 58, and exiting the drum 58 into the operator's hand 68. Rotation of drum handles 62 and 64 in the direction indicated by the arrows applies a force to the load end of the rope 66 as a result of the friction between the rope 66 and the surface of the drum 58, as long as an operator, indicated schematically by the hand 68, applies an adequate force to the exiting end of the rope 66. As the drum 58 is rotated, coils of rope 66 are added to the winch drum section near the base 60, and at the same time, an equal number of coils of rope 66 are removed from the drum 58 as the winch operator 68 continues to pull on the rope 66.

The formation of the added coils from the incoming rope 66 on the inner end of the drum 58 and the corresponding removal of coils by the exiting of rope at the outer end of the drum makes the coils appear to be "corkscrewing" axially inwardly on the drum 58 as the drum is rotated in the clockwise direction indicated by the direction arrows in FIG. 3.

FIG. 4 illustrates the configuration of the coils of rope 66 on the winch drum 58 after the surface of the drum 58 adjacent to the base is covered by coils of rope labeled A, B, C, D, and E from rotation of the drum 58 as discussed for FIG. 3. As shown, coil A is in contact with the base-end flange of the winch drum 58 and any further turning of the drum 58 forces the incoming rope 66 to begin overlapping the existing coils of rope 66 already on the drum 58.

FIG. 5 illustrates that when the winch drum 58 in FIG. 4 is rotated approximately one turn, the newly added rope coil F overlaps portions of rope coils A and B. Rope coil E, as illustrated in FIG. 4, is rotated off the drum 58 by one turn of the drum 58, as illustrated in FIG. 5. Further turning of the drum will result in additional overlapping of coils of rope 66 and prevents the operation of the apparatus 56 in lowering loads attached to the load rope 66. Further operation is prevented because the force of the overlapping coils on the underlying coils prevent the coils from unwrapping from the drum even though the operator applies no tension force on the exiting rope 66.

FIG. 6 is a side view of a segment of the winch apparatus 56 as indicated by line segment 6—6 in FIG. 5 and provides more detail on the configuration of the overlapping rope coil F illustrated in FIG. 5.

FIGS. 7 and 8 illustrate one preferred embodiment of the present invention. The antioverlap apparatus indicated generally by the numeral 70 is attached to the structural frame of a winch apparatus 74 which is a type commonly used in the tree service industry and described in my prior U.S. Pat. No. 5,484,253 entitled *Conformed Frame Apparatus For Handling Loads Involved In Arbor Rigging Procedures*. This U.S. Pat. No. 5,484,253 is incorporated by reference in this application.

In an isometric view, FIG. 7 shows the winch apparatus 74 mounted on a tree, with most of the tree shown broken away, for convenience in viewing in this schematic illustration. The winch drum 72 is manually rotated in one direction clockwise with a winch bar 76 and is constrained from rotating in the other direction by a ratcheting gear device (not shown). The load end of the rope 78 enters the winch apparatus from above, is coiled around the winch drum 72, and exits the drum 72 through the fairlead hook 80 of the antioverlap apparatus 70. The winch apparatus operator 82, illustrated schematically by the hand, maintains a tension force on the exiting rope 78 during operation of the winch apparatus 74. The rotatable roller 84 of the antioverlap apparatus 70 is positioned on the frame side of the entering load rope 78. The outer surface of the roller 84 engages the side surface of the incoming coil of rope and exerts a sufficient force on the body of the incoming rope coil to shift all previously formed engaging, adjacent coils of rope along the surface of the drum 72 in a direction along the axis of rotation of the drum 72. This axial shifting of the coils makes room for the formation of the incoming rope coil directly on the surface of the drum 72 and thereby avoids any crossing or overlapping of the incoming coil onto the previously formed adjacent coils.

As illustrated in FIG. 8, the gusset 88 is welded to the structural tubing 86 and to the roller shaft support tube 97 to strengthen the support structure of the antioverlap apparatus 70. For further structural strength the gusset 88 (as seen in FIG. 7) contacts the frame of the winch apparatus 74 by the selection of the length of the tubing insert 90.

The antioverlap apparatus 70 is attached to the frame of the winch apparatus by the mounting bracket 102 with two bolts 104 and 106. The attachment tube 98 is welded at selected angles to the mounting brackets 102.

The roller shaft tube 97 is threaded internally to accept the threaded roller shaft 92. The spacing between the end of the roller 84 and the surface of the winch drum 72 (as seen in FIG. 7) is adjusted by screwing the roller shaft 92 into the roller shaft support tube 97 and then tightening the lock nuts 94 and 96 against the support tube 97.

FIG. 9 is an exploded isometric view of the components of the antioverlap apparatus 70 illustrated in FIG. 7 and 8. The attachment tube 98 is welded to the frame attachment bracket 104 at angles $\phi$ and $\Omega$ such that the axis of the attachment rod 99, when mounted on the winch apparatus 74 as illustrated in FIG. 7 and 8, is approximately parallel to the axis of the winch drum 72. The letters V and H indicate the vertical and horizontal axes of the isometric drawing of FIG. 9.

The axis of the roller shaft 92 is selected at an angle $\Theta$ such that when the antioverlap controller is mounted on a winch apparatus the axis of the roller shaft approximately intersects the axis of the winch drum 72 as illustrated in FIGS. 7 and 8. The angle T is selected such that the axis of the roller shaft 92 intersects the surface of the winch drum 72 at approximately 90° to the surface.

The angle $\beta$ of the parallel end cuts on the tubing insert 90 and the adjacent angle cuts on the attachment tube 98 and the structural support tube 86 are the same and approximately 45° to the axis of the attachment rod 99 in this embodiment. This feature ensures automatic and precise realignment of the roller 84 relative to the winch drum 72 when the support tubing and attached components are removed and then later re-attached to the support tube 98 by the support rod 99 and the nut 100 as illustrated in FIG. 8.

The angles of the fairlead hook 80 are selected, depending on the location of the roller 84 relative to the drum of the winch apparatus, for effective and safe control of the exiting rope by the winch apparatus operator. The fairlead hook 80 and the support rod 99 are welded to the structural support tube 86.

FIGS. 10, 11 and 12 schematically illustrate the method of operation of an embodiment of the antioverlap apparatus 108 attached to a winch apparatus 107 to slide coils of rope axially along the surface of a winch drum to prevent overlapping of coils on the drum.

In FIG. 10, the load end of the rope 110 enters the winch apparatus 107 from above as indicated by rope segment F, and the rope 110 exits near the open end of the winch drum 112 into the hand 116 of the operator who keeps tension on the exiting rope. Rope coils A, B, C, D and E are shown in contact with adjacent coils, and coil A is in contact with the surface of the roller 114.

After the winch drum 112, as illustrated in FIG. 10, has been rotated clockwise by approximately one full turn, FIG. 11 illustrates the new rope configuration for the winch apparatus 107. A new coil of rope F has been added to the drum 112 and coil E has exited the drum as illustrated in FIG. 11. Rope coils A, B, C and D have been slid axially along the surface of the drum 112 by the proximately perpendicular surface force of the roller 114 rolling along and pushing locally on the entering rope coil F as it contacts the roller surface. Thus, a portion of the rotational force applied to the winch apparatus drum is transformed by the roller of the antioverlap apparatus 108 to a force on the rope coils approximately parallel to the axis and to the surface of the winch drum thereby sliding the rope coils axially along the drum.

Further detail of the method of operation of the roller 114 in interaction with the entering rope coil F is illustrated in FIG. 12 for the side view indicated by line segment 12—12 in FIG. 11. As the rope segment of coil F, which is in contact with the surface of the drum 112, approaches the location of contact with the surface of roller 114, the rope segment is wedged between the rotating surface of the roller 114 and the surface of rope coil A, thereby forcing coil A and adjacent rope coils B, C, and D to incrementally slide axially over the surface of the drum 112. The surface of the roller 114 rolls over the surface of coil F at its points of local contact and produces a similar axial displacement of coil F with approximately zero sliding friction between the roller surface and the rope surface. The axial sliding of the rope coils on the surface of the drum is indicated by the axially-directed arrow on the rope coils.

FIGS. 13, 14 and 15 illustrate how operational forces resulting from the attached antioverlap apparatus 126 are transferred via rope coils 122 to the inner structure of a winch apparatus 132. FIG. 13 is an isometric view similar to FIG. 7, but parts of FIG. 13 have been illustrated in phantom outline to show underlying locations of bearing assemblies and ratchet gear assemblies of the apparatus illustrated in FIG. 7. FIG. 14 also shows schematically the coils of rope 122 as a phantom overlap on the winch drum 120. The roller 124 location of the antioverlap apparatus 126 is adjacent to the rope coil nearest to the frame attachment end of the winch axle 134. The winch gear 128, which is rigidly attached to the coupling block 140, and the ratchet pawl 136 are shown adjacent to the vertical frame member 130. The rear bearing 138 is mounted in the coupling block 140 that couples the winch gear 128 to the winch drum 120.

FIG. 14 illustrates a side view of the winch drum 120 and axle 134 in a partial schematic cut away to illustrate the winch drum force on the nose thrust bearing 142 that results from the operation of the antioverlap apparatus 126 attached to the winch apparatus 132, as seen in FIG. 13. When the winch drum 120 is rotated, as discussed for FIG. 7, the surface of roller 124 applies an axial force on the coils of rope 122 as illustrated and discussed for FIG. 12. As the coils of rope 122 slide axially as indicated by the arrow on the rope coils, the frictional forces between the inner surfaces of the winch coils and the outer surface of the wince drum produce an axially directed force on the outer surface of the winch drum 120. This force is directly transferred by the internal structure of the drum to the nose thrust bearing 142, as indicated by the two direction arrows acting on the thrust bearing 142 and shown between the inner surface of the winch drum and the outer surface of the shaft 134. The operational axial forces on the thrust bearing 142 and on the surface of the roller 124 are approximately equal and are important factors in establishing the rotational torques required for winch apparatus 132.

FIG. 15 illustrates, in partial cross section, a portion of the roller assembly as indicated in FIG. 14 by the arrows 15—15. Because high fleeting forces can occur at the interface between the surface of roller 124 and the rope coils 122 during operation of the winch apparatus 132 illustrated in FIG. 13, low friction ball bearings are used in roller 124. The support shaft 123 is threaded, and the spacing between roller 124 and the winch drum 120 is adjusted by screwing the shaft-122 into or out of the structural support tube 127. The lock nuts 125 are then securely tightened against the support tube 127 to prevent the support shaft 123 from rotating during operation of the winch apparatus 132 illustrated in FIG. 13.

FIG. 16 is a schematic isometric view illustrating a power-driven winch apparatus 150 having coil engaging roller mechanisms 160, 162, and 164 constructed in accordance with another embodiment of the present invention and attached to the winch apparatus structure 150. Power-driven winches are commonly used for utility line maintenance and installations for winch loads up to two tons and for nautical applications.

The load end of the load rope 159 approaches the winch drum 156 from above; and, after five coils on-the winch drum 156, the tail end of the load rope 159 exits the drum through the fairlead hook 166 into the winch apparatus operator's hand 168. The operator maintains a tension force on the exiting rope 159. The rollers 170, 172, and 174 are positioned axially in a spiral pattern around the drum 156. Portions of the surface of the entering first coil of rope 159 remains in contact with the surfaces of rollers 170, 172 and 174 such that the force required to slide the coils of rope 159 axially along the surface of the winch is approximately shared equally by the rollers 170, 172 and 174 when the winch drum 156 is rotating. The axial positions of the rollers 170, 172 and 174 may be adjusted to achieve approximate equal load sharing by selection of the length of the tubing inserts 176, 177 and 178 and lengths of gussets 180, 182 and 184.

FIG. 17 illustrates an embodiment of the antioverlap apparatus 188 in which the axial position of the structural gusset 190 with respect to the winch drum 196 and to the roller 198 may be easily adjusted to achieve firm contact with the frame 199 of the winch apparatus. See the discussion of FIG. 16 immediately above for discussion of the length of tubing inserts. After bolts 192 and 194 are loosened, the gusset 190 may be adjusted axially due to the slot in the gusset 190 and affixed in a new position by tightening bolts 192 and 194.

The adjustable gusset 190 is particularly effective for use with multiple roller mechanisms as illustrated in FIG. 16 when small field adjustments may be required by winch operators to allow for changes in rope diameter or compressibility FIG. 18 illustrates an embodiment of the present invention attached to a manually-operated, self-fleeting winch apparatus 200 of a type commonly used for controlling sails on sailing vessels. The surface of winch drum 204 is axially contoured to produce self fleeting of the coils of rope 206 axially along the drum. However, even with skilled operators of this type of self fleeting winches, overlapping of rope coils on self fleeting winch drums remains a common problem. Such overlapping can occur particularly when slack in the load rope develops between the winch and the load attach point and the operator pulls rapidly on the tail end of the rope to remove the slack. The overlapping of the coils can be prevented by use of the antioverlap apparatus 202, as illustrated in FIG. 18.

In FIG. 18, the position and the angle of the entrance rope 206 onto the winch drum 204 are established by the pulley apparatus 203. Six coils of rope 206 are shown on the drum in a cut-away presentation, with the rope 206 exiting the drum through a guide hook 208 into the hand 210 of the winch apparatus 200 operator. The operator maintains a tension in the exiting rope 206.

As the winch drum 204 is manually rotated clockwise by the operator, the surface of the roller 212 of the antioverlap apparatus 202 contacts a portion of the surface of the entering coil of rope 206 and thereby applies a fleeting force approximately parallel to the surface of the winch drum 202 at the approximate point of rolling contact of the rope 206 with the surface of the roller 212.

By selection of the positions of the slotted attachment plate 217 and the support stand 219, the axis of roller 212 is positioned to be approximately perpendicular to the winch drum surface and to approximately intersect the axis of the winch drum 204. The roller shaft housing 215 is threaded internally such that the threaded roller shaft 211 is screwed into it and locked into position by the lock nut 213 to prevent rotation of the roller shaft 211 during operation of the winch apparatus 200. The mounting plate 217 is welded to the roller shaft housing 215 and attached with bolts through two adjustment slots to the attachment stand 219. The slotted mounting plate 217 provides for a selected range of rotation and translation of the axis of the roller 212. This feature enables the positioning of the roller axis with respect to the surface and the axis of the winch drum 204. The threaded roller shaft 211 enables the space between the winch drum 204 and the roller 212 to be adjusted during the initial installation of the antioverlap apparatus 202 with the winching device 200 and for subsequent operational wear on components such as bearings of the winch device 200.

In FIG. 18 the antioverlap apparatus 202 is rigidly attached to the frame plate 214 of the winch apparatus 200. The antioverlap apparatus 202 could be attached directly to the deck rather than to the frame plate 214.

While I have illustrated and described the preferred embodiments of my invention, it is to be understood that these are capable of variation and modification, and I therefore do not wish to be limited to the precise details set forth, but desire to avail myself of such changes and alterations as fall within the purview of the following claims.

I claim:

1. A method of preventing overlap of coils of a cable on a rotatable winch drum, said method comprising, engaging an incoming portion of a cable on an outer, curved, peripheral surface of a winch drum at an incoming end portion of said drum, rotating said drum to start the formation of an incoming coil of cable on said drum, mounting a rotatable roller at a selected location with respect to the axis of rotation of said drum, said selected location being near the incoming coil of cable, engaging the outer surface of the rotatable roller with a side surface of the incoming coil of the cable as the incoming coil is being formed, exerting a sufficient force through the roller and the cable of the incoming coil to maintain the roller engaged portion of the incoming coil at the location of the rotatable roller and to shift all previously formed engaging adjacent coils of the cable sufficiently longitudinally on the surface of said drum in a direction along the axis of rotation of said drum so as to make room for the formation of the incoming coil directly on the surface of said drum and without any crossing or overlapping of the incoming coil on the previously formed adjacent coils.

2. The invention defined in claim 1 wherein the cable is a rope.

3. The invention defined in claim 1 wherein the cable is a metal strand cable.

4. The invention defined in claim 1 wherein the rotatable roller is constructed to enable the outer surface to roll along the side surface of the incoming coil with little or no slippage to thereby eliminate or minimize sliding friction between the outer surface of the rotatable roller and the side surface of the incoming coil of the cable.

5. The invention defined in claim 1 wherein the drum has a generally right circular cylindrical outer surface on which the coils of the cable are formed.

6. The invention defined in claim 1 wherein the drum has an outer surface formed to a curved configuration which enables at least some self fleeting of the coils of cable formed on the drum.

7. The invention defined in claim 6 wherein the rotatable roller is mounted for rotation on a support shaft and wherein the support shaft is adjustable both in distance and in angle of inclination with respect to the main frame to produce the desired engagement of the outer surface of the rotatable roller with the side surface of the incoming coil of the cable as the incoming coil is being formed.

8. The invention defined in claim 1 including mounting multiple rollers at selected locations with respect to the axis of rotation of the drum so as to engage the outer surface of each rotatable roller with a related side surface of the incoming coil of cable as the incoming coil is being formed.

9. The invention defined in claim 1 including guiding the incoming portion of the cable onto the drum by a first guide means.

10. The invention defined in claim 9, wherein the cable has an exit end and the method including guiding the exit end of the cable off the drum by a second guide means.

11. The invention defined in claim 1 including mounting the drum for rotation on a main frame and wherein the rotatable roller is also mounted on said main frame.

12. The invention defined in claim 11 including positioning a low friction thrust bearing in the mounting for the rotatable winch drum at a location to absorb the longitudinal thrust produced by longitudinal shifting of the coils of the cable on the outer surface of the drum.

13. The invention defined in claim 11 wherein the rotatable roller is mounted for rotation on a support shaft and wherein roller bearings are used between the rotatable roller and the support shaft to minimize friction during rotation of the roller on the support shaft.

14. The invention defined in claim 11 wherein the rotatable roller is mounted for rotation on one end portion of a support shaft and the other end portion of the support shaft is threaded so that the location of the rotatable roller can be adjusted in a direction along the axis of the support shaft.

15. The invention defined in claim 14 including a support tube for mounting the support shaft and wherein the support tube is mounted on a structural tube which is in turn mounted on an attachment connected to the main frame.

16. Apparatus for preventing overlap of coils of a cable on a rotatable winch drum, said apparatus comprising, a rotatable winch drum having an outer, curved, peripheral surface for receiving an incoming end portion of a cable and for permitting the formation of multiple, adjacent coils on said peripheral surface during operation of the winch drum as the winch drum is rotated, said winch drum being rotatable in one direction to start the formation of an incoming coil of cable on the said drum, a rotatable roller mounted at a selected location with respect to the axis of rotation of the winch drum, said selected location being near the incoming coil of cable, said rotatable roller having an outer surface engageable with a side surface of the incoming coil of the cable as the incoming coil is being formed, said rotatable roller exerting a sufficient force through the roller and the cable of the incoming coil to maintain a roller engaged portion of the incoming coil at the location of the rotatable roller and to shift all previously formed engaging adjacent coils of the cable sufficiently longitudinally on the peripheral surface of the winch drum in a direction along the axis of rotation of the winch drum so as to make room for the formation of the incoming coil directly on the surface of the winch drum and without any crossing or overlapping of the incoming coil on the previously formed adjacent coils.

17. The invention defined in claim 16 wherein the cable is a rope.

18. The invention defined in claim 16 wherein the cable is a metal strand cable.

19. The invention defined in claim 16 wherein the rotatable roller is constructed to enable the outer surface to roll along the side surface of the incoming coil with little or no slippage to thereby eliminate or minimize sliding friction between the outer surface of the rotatable roller and the side surface of the incoming coil of the cable.

20. The invention defined in claim 16 wherein the drum has a generally right circular cylindrical outer surface on which the coils of the cable are formed.

21. The invention defined in claim 16 wherein the drum has an outer surface formed to a curved configuration which enables at least some self fleeting of the coils of cable formed on the drum.

22. The invention defined in claim 21 wherein the rotatable roller is mounted for rotation on a support shaft and wherein the support shaft is adjustable both in distance and in angle of inclination with respect to the main frame to produce the desired engagement of the outer surface of the rotatable roller with the side surface of the incoming coil of the cable as the incoming coil is being formed.

23. The invention defined in claim 16 wherein multiple rollers are mounted at selected locations with respect to the axis of rotation of the drum so as to engage the outer surface of each rotatable roller with a related side surface of the incoming coil of cable as the incoming coil is being formed.

24. The invention defined in claim 16 including first guide means for guiding the load end of the cable onto the drum and second guide means for guiding the exit end of the cable off of the drum.

25. The invention defined in claim 16 including a main frame and drum mounting means for mounting the drum for rotation on the main frame and including rotatable roller mounting means for also mounting the rotatable roller on said main frame.

26. The invention defined in claim 25 including a low friction thrust bearing positioned in the drum mounting means to absorb the longitudinal thrust produced by longitudinal shifting of the coils of the cable on the outer surface of the drum.

27. The invention defined in claim 25 wherein the rotatable roller is mounted for rotation on a support shaft and wherein roller bearings are used between the rotatable roller and the support shaft to minimize friction during rotation of the roller on the support shaft.

28. The invention defined in claim 25 wherein the rotatable roller is mounted for rotation on one end portion of a support shaft and the other end portion of the support shaft is threaded so that the location of the rotatable roller can be adjusted in a direction along the axis of the support shaft.

29. The invention defined in claim 28 including a support tube for mounting the support shaft and wherein the support tube is mounted on a structural tube which is in turn mounted on an attachment connected to the main frame.

* * * * *